US006250113B1

(12) United States Patent
Wang

(10) Patent No.: US 6,250,113 B1
(45) Date of Patent: Jun. 26, 2001

(54) STRUCTURE FOR ADJUSTING GAP BETWEEN AN ANCHOR SEAT AND A NEEDLE DRUM SEAT OF A CIRCULAR KNITTING MACHINE

(75) Inventor: Ping-Shin Wang, Taipei Hsien (TW)

(73) Assignee: Pai Lung Machinery Mill Co., Ltd., Taipei Hsien (TW)

( * ) Notice: Subject to any disclaimer, the term of this patent is extended or adjusted under 35 U.S.C. 154(b) by 0 days.

(21) Appl. No.: 09/767,914

(22) Filed: Jan. 24, 2001

(51) Int. Cl.[7] ..... D04B 15/32
(52) U.S. Cl. ..... 66/8; 66/57
(58) Field of Search ..... 66/7, 8, 13, 17, 66/19, 38, 215, 222, 223, 224, 57, 114, 115

(56) References Cited

U.S. PATENT DOCUMENTS 1,679,171 * 7/1928 Pickell ..... 66/20
1,785,603 * 12/1930 Swinglehurst ..... 66/20
3,013,418 * 12/1961 Hill ..... 66/20
3,387,469 * 6/1968 Beckenstein ..... 66/20
3,670,526 * 6/1972 Martinetz ..... 66/20
3,882,694 * 5/1975 Stepanek et al. ..... 66/54
3,926,013 * 12/1975 Kurth et al. ..... 66/40
4,054,042 * 10/1977 Durville ..... 66/57
5,172,569 * 12/1992 Schnurrer ..... 66/8
5,682,770 * 11/1997 Wang ..... 66/57

* cited by examiner

*Primary Examiner*—Danny Worrell
(74) *Attorney, Agent, or Firm*—Bacon & Thomas, PLLC

(57) ABSTRACT

An improved structure for adjusting the gap between an anchor seat and a needle drum seat of a circular knitting machine, and particularly an anchor seat coupled with a cam, has a fine tune bore and a positioning bore formed in the anchor seat, and a slide trough formed at the bottom side of the anchor seat for housing a slide block. A positioning bolt is provided to fasten the slide block to the anchor seat, and a fine tune bolt is provided to fasten the anchor seat and slide block to a lower lozenge ring. Through a lightly tapping on the anchor seat and fastening and unfastening the fine tune bolt and positioning bolt, the gap between the anchor seat and needle drum seat may be adjusted precisely thereby to prevent the needles located in the needle drum seat from hitting the cam or dropping, and enable the circular knitting machine to perform knitting operation smoothly and precisely.

2 Claims, 5 Drawing Sheets

PRIOR ART Fig. 1

STRUCTURE FOR ADJUSTING GAP BETWEEN AN ANCHOR SEAT AND A NEEDLE DRUM SEAT OF A CIRCULAR KNITTING MACHINE

BACKGROUND OF THE INVENTION

This invention relates to a structure for adjusting gap between an anchor seat and a needle drum seat of a circular knitting machine and specifically an improved structure for an anchor seat coupled with a cam for preventing knitting needle located in the needle drum seat from hitting the cam or dropping thereby for the circular knitting machine to achieve smooth and precise knitting operation.

A conventional anchor seat A (shown in FIG. 1) for a circular knitting machine usually includes a base A1 which has a slant positioning bore A11 for housing a fastening bolt C to engage with a lower lozenge ring B. The anchor seat A does not have adjustment means to fine tune the gap formed between the needle drum seat A2. Hence the end surface A2 of the anchor seat A has to be fabricated very precisely during machining to match the cam E. Too thick or too thin of the end surface will result in the knitting needles hitting the cam E or dropping of needles (located in the needle drum seat D) during knitting operation.

However conventional anchor seat cannot totally eliminate the problems resulting from not precision of machining. Unless it is made extremely precise, a slightly too thick will cause the gap between the needle drum seat and cam too small and result in the needles located in the needle drum seat hitting the cam; a slightly too thin will cause the gap between the needle drum seat and cam too large and result in the needles located in the needle drum seat dropping during knitting operation. All this will cause defect of the knitting fabric. Hence unless the anchor seat is precisely made, the subsequent operation will be adversely affected.

SUMMARY OF THE INVENTION

In view of the foregoing disadvantages, it is therefore an object of this invention to provide an improved structure that may make adjustment of the gap between an anchor seat and a needle drum seat more precise and easier thereby to enable the circular knitting machine to perform knitting operation smoothly and precisely.

In one aspect of this invention, the adjustment of the gap is done by tapping lightly the anchor seat, and fastening or unfastening two adjustment bolts in two bores. The gap between the anchor seat and needle drum seat may be adjusted precisely thereby to prevent the needles located in the needle drum seat from hitting the cam or dropping, and consequently make knitting operation running smoothly and precisely.

BRIEF DESCRIPTION OF THE DRAWINGS

The invention, as well as its many advantages, may be further understood by the following detailed description and drawings.

DESCRIPTION OF THE PREFERRED EMBODIMENT

Figure 1:
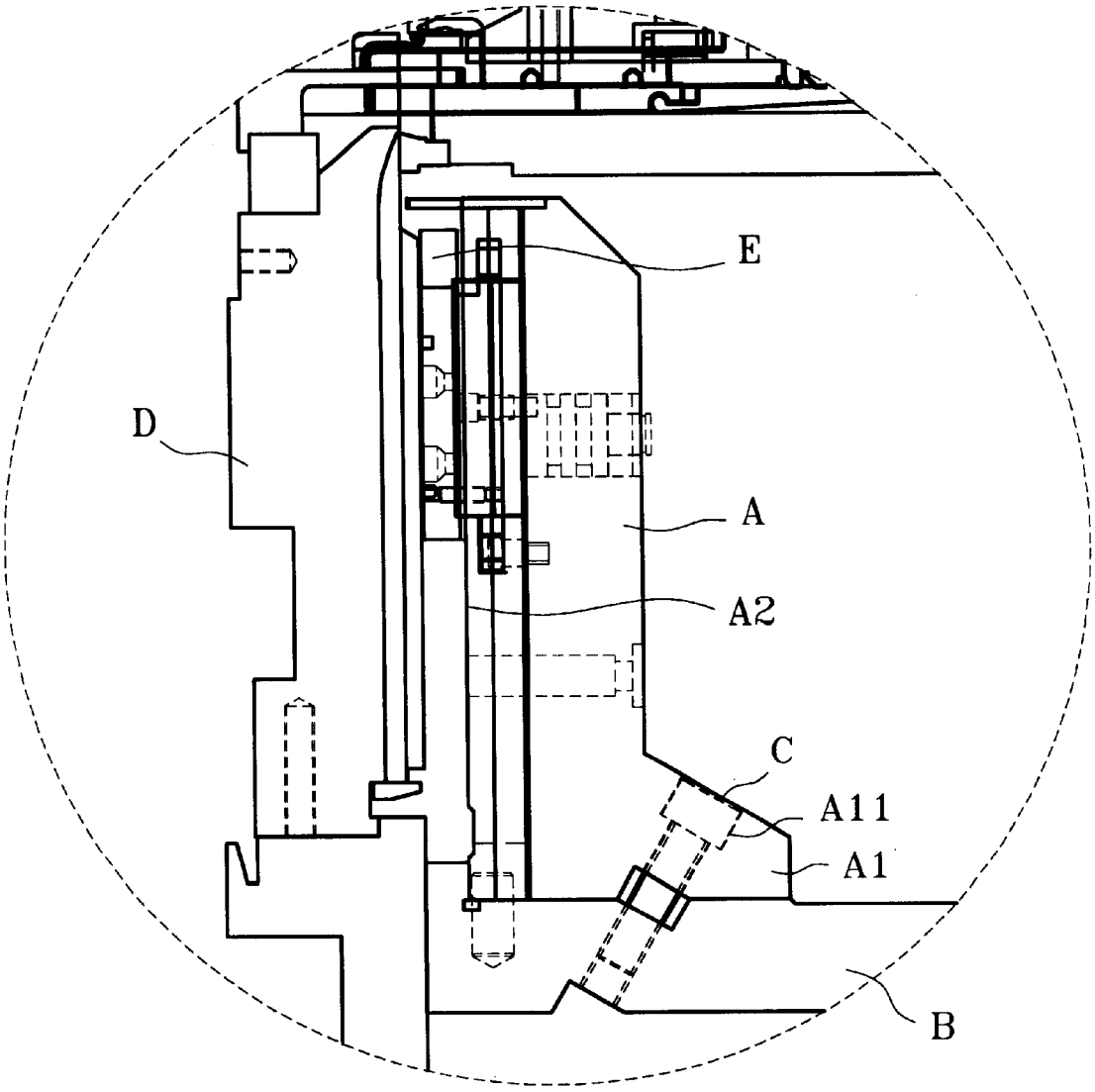
FIG. 1 is a schematic view of a conventional adjustment means in use.
Figure 2:
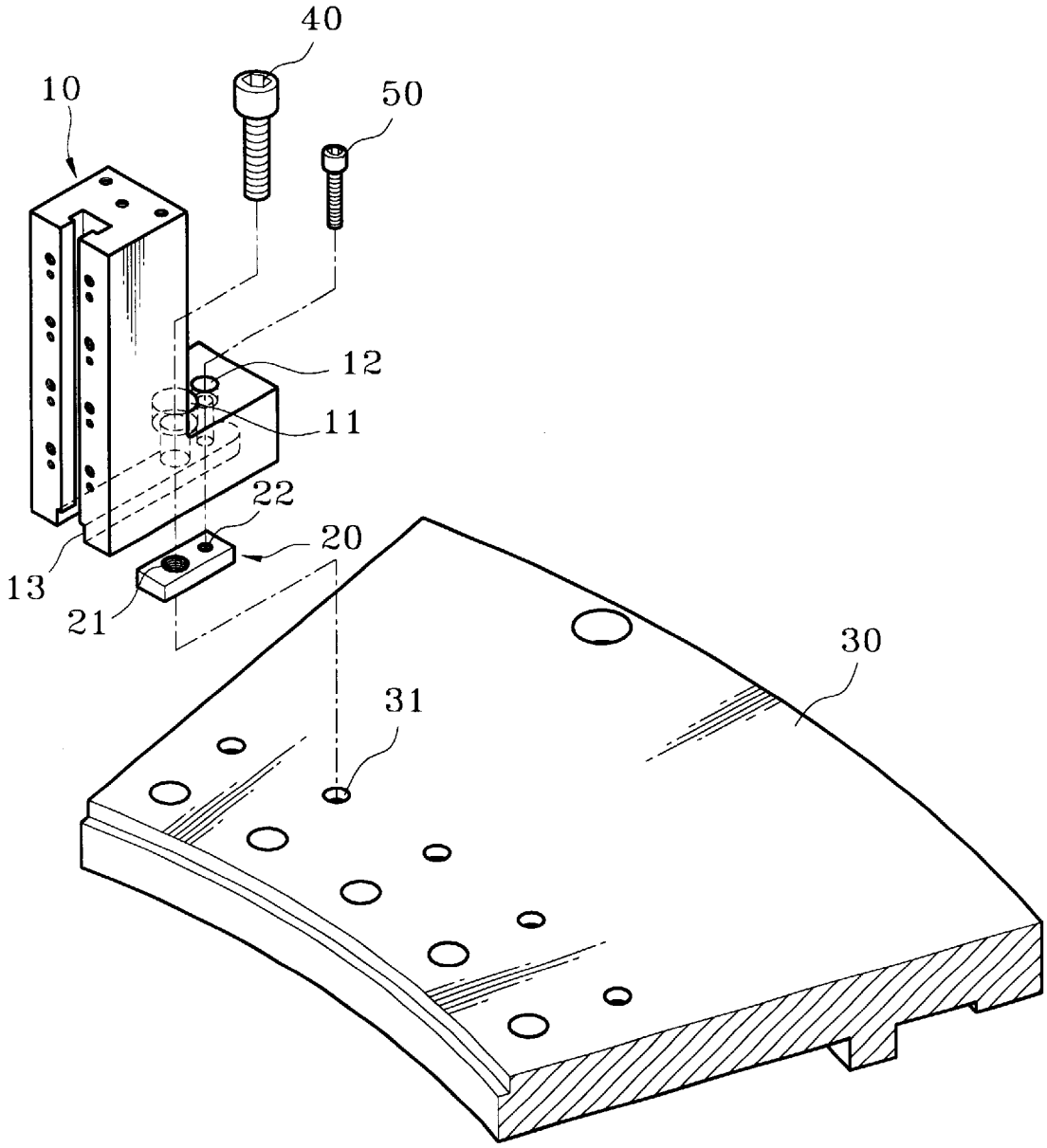
FIG. 2 is an exploded view of this invention.
Figure 3:
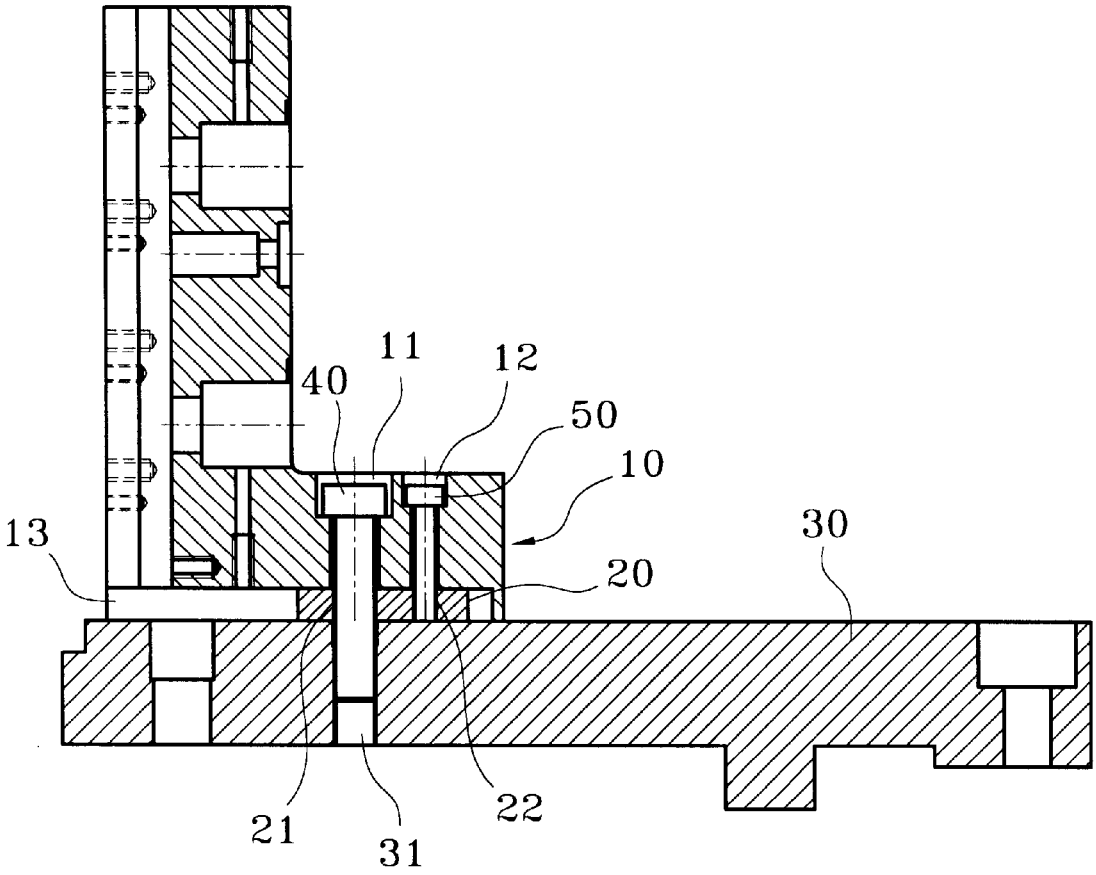
FIG. 3 is a sectional view of this invention.

Referring to FIGS. 2 and 3, this invention provides a structure for adjusting the gap between the anchor seat and needle drum seat. The anchor seat 10 has a base in which there is a fine tune bore 11 and a positioning bore 12 running through the base and reaching a slide trough 13 formed at the bottom side of the base. A slide block 20 is provided to slide into the slide trough 13. The slide block 20 has a fine tune screw bore 21 and a positioning screw bore 22 mating respectively against the fine tune bore 11 and positioning bore 12. The diameter of the fine tune bore 11 is slightly larger than the fine tune screw bore 21 and thus may create a fine tuning effect for adjusting the gap. The anchor seat 10 and slide block 20 may be fastened to a lower lozenge ring 30 through a fine tune bolt 40 and a positioning bolt 50. The lower lozenge ring 30 also has a fine tune screw aperture 31 formed therein.

Figure 4A:
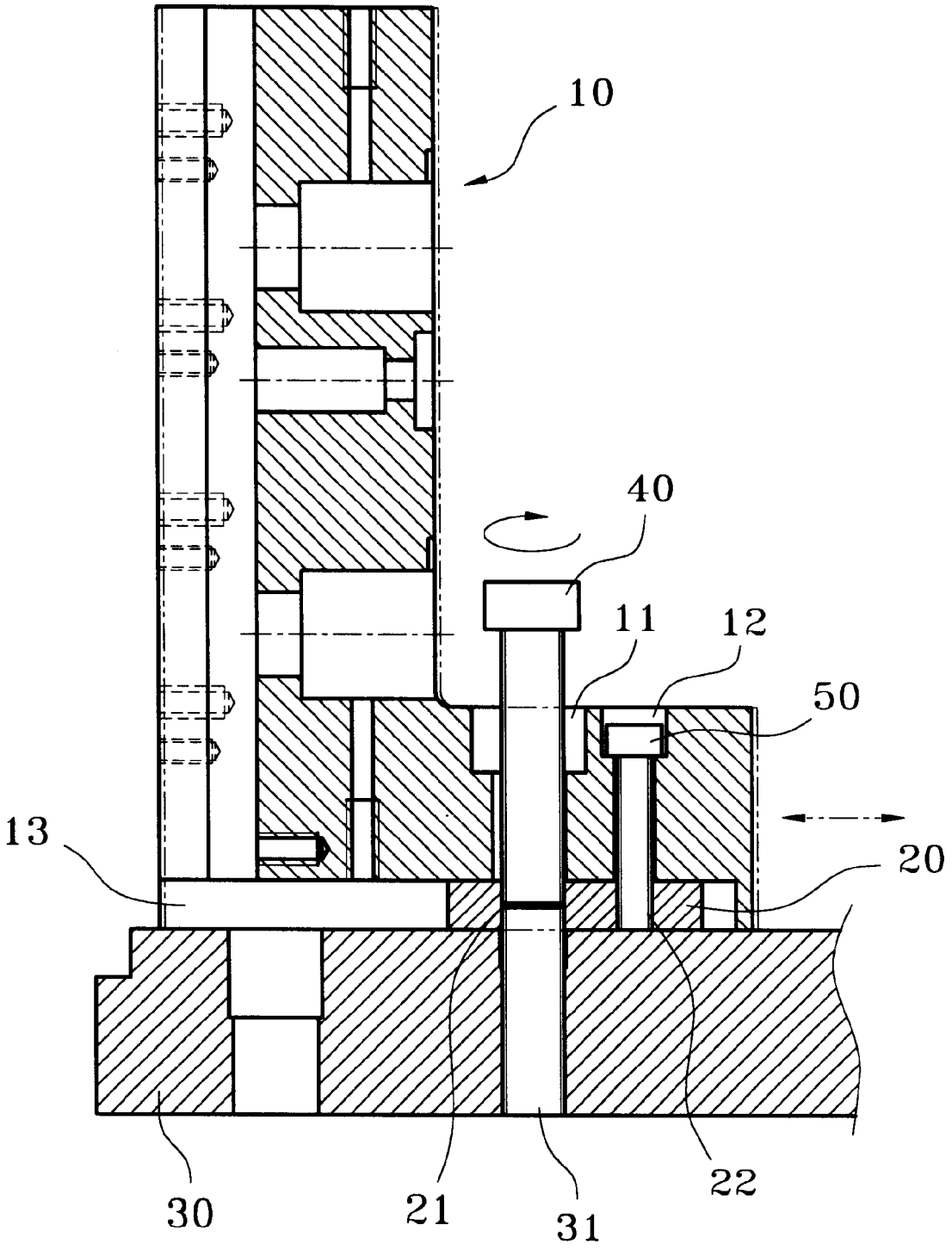
FIG. 4A is a sectional view of this invention in use, for fine tune adjustment.
Figure 4B:
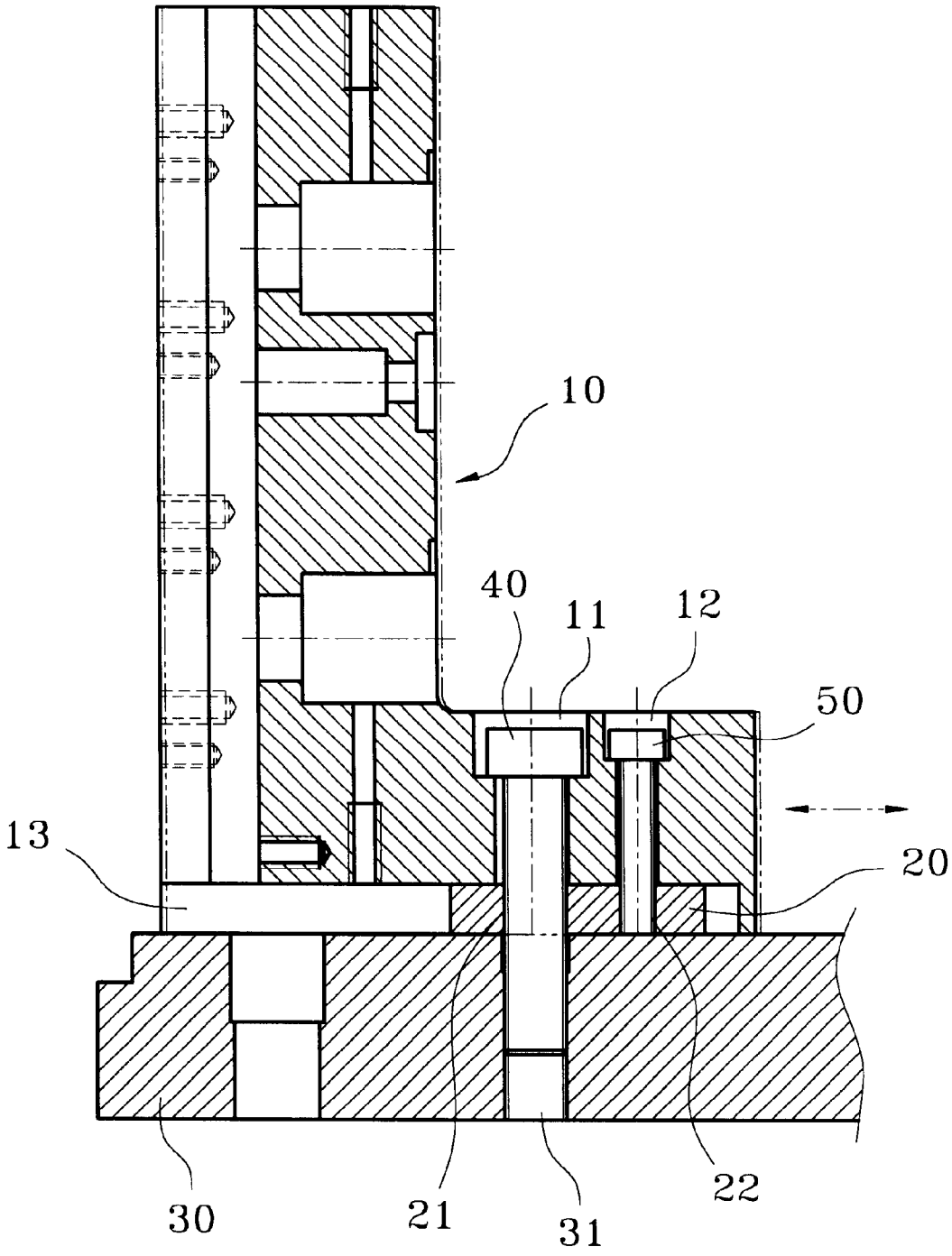
FIG. 4B is another sectional view of this invention in use, for fine tune adjustment.

Referring to FIGS. 4A and 4B, when in use, tap the anchor seat 10 lightly until it reaching a position desired; the fasten the positioning bolt 50 through the positioning bore 12 to engage the anchor seat 10 with the slide block 20; then fasten the fine tune bolt 40 tightly for holding the anchor seat 10 securely at a location desired.

Because the fine tune bore 11 has a slightly larger diameter than the fin tune screw bore 21, this difference is the basis of this invention for doing a fine tune adjustment. When there is a need for replacing the anchor seat 10, unfasten the fine tune bolt 40 and remove the anchor seat 10 from the lower lozenge ring 30, and dispose another anchor seat 10 or a cam (not shown in the figures) at the location desired to adjust the gap. When there is a need for fine tuning the gap between the anchor seat 10 and needle drum seat (not shown in the figures), fasten or unfasten the fine tune bolt 40 to make adjustment until reaching the position desired. By means of this fine tuning process, the knitting needles located in the needle drum seat will be prevented from hitting the cam resulting from a too small gap, or dropping because of a too large gap. As a result, the circular knitting machine may perform knitting operation smoothly and precisely.

In summary, this invention provides a structure for adjusting the gap between the anchor seat 10 and needle drum seat. Through lightly tapping the anchor seat 10 and fastening or unfastening a fine tune bolt 40 and a positioning bolt 50 in a fine tune bore 11 and a positioning bore 12, the gap between the anchor seat 10 and needle drum seat may be adjusted precisely thereby to prevent the needles located in the needle drum seat from hitting the cam or dropping, and consequently enable the circular knitting machine to perform knitting operation smoothly and precisely.

What is claimed is:

1. An structure for adjusting a gap between an anchor seat mounted on a lower lozenge ring and a needle drum seat of a circular knitting machine, comprising:

an anchor seat having a base which has a fine tune bore and a positioning bore formed therein, and a slide trough formed at a bottom side thereof;

a slide block slidable in the slide trough having a fine tune screw bore and a positioning screw bore formed therein mating respectively with the fine tune bore and positioning bore;

a fine tune bolt for fastening the anchor seat and slide block to the lower lozenge ring through the fine tune bore and fine tune screw bore; and a positioning bolt for fastening the slide block to the anchor seat through the positioning bore and positioning screw bore;

wherein the gap between the anchor seat and needle drum seat is adjustable by tapping the anchor seat and fastening or unfastening the fine tune bolt and positioning bolt such that needles located in the needle drum seat will be prevented from hitting a cam or dropping thereby to enable the circular knitting machine to perform knitting operation smoothly and precisely.

2. The structure of claim 1, wherein the fine tune bore has a larger diameter than the fine tune screw bore for fine tune adjustment of the gap.

* * * * *